US009915040B2

(12) United States Patent
Bletscher et al.

(10) Patent No.: US 9,915,040 B2
(45) Date of Patent: Mar. 13, 2018

(54) SOIL COMPACTOR

(71) Applicant: Hamm AG, Tirschenreuth (DE)

(72) Inventors: Thomas Bletscher, Bechtsried (DE); Gerd Köstler, Tirschenreuth (DE); Axel Römer, Tirschenreuth (DE)

(73) Assignee: Hamm AG, Tirschenreuth (DE)

( * ) Notice: Subject to any disclaimer, the term of this patent is extended or adjusted under 35 U.S.C. 154(b) by 0 days.

(21) Appl. No.: 15/489,767

(22) Filed: Apr. 18, 2017

(65) Prior Publication Data

US 2017/0306571 A1 Oct. 26, 2017

(30) Foreign Application Priority Data

Apr. 21, 2016 (DE) ..... 10 2016 107 366

(51) Int. Cl.
*E01C 19/00* (2006.01)
*E01C 19/23* (2006.01)
(Continued)

(52) U.S. Cl.
CPC ..... *E01C 19/264* (2013.01); *E01C 19/004* (2013.01); *E01C 19/23* (2013.01); *E02D 3/026* (2013.01); *E02F 3/815* (2013.01); *E02F 3/961* (2013.01); *E02F 3/967* (2013.01); *E01C 2301/40* (2013.01); *E02F 9/2271* (2013.01)

(58) Field of Classification Search
CPC ..... E01C 19/264; E01C 19/004; E01C 19/23; E01C 19/43; E01C 19/236; E01C 19/25; E01C 21/00; E02D 3/026; E02D 3/039; E02D 3/046; E02D 3/0265; E02D 3/02;
(Continued)

(56) References Cited

U.S. PATENT DOCUMENTS 2,302,964 A 11/1942 Le Tourneau
2,911,893 A * 11/1959 Archibald ..... E02D 3/026 209/285
(Continued)

FOREIGN PATENT DOCUMENTS

DE 20103327 5/2001
DE 112011103168 8/2013
(Continued)

OTHER PUBLICATIONS

Search Report of DE Application No. 10 2016 107 366.0 dated Feb. 1, 2017, 7 pages.
(Continued)

*Primary Examiner* — Abigail A Risic
(74) *Attorney, Agent, or Firm* — Rankin, Hill & Clark LLP

(57) ABSTRACT

Soil compactor including a compaction drum rotatably supported by a compaction roller frame, wherein the compaction drum frame comprises two longitudinal members arranged in a direction longitudinal to the compactor on both sides of the compaction roller and supporting said compaction roller, and, connecting the two longitudinal members together, two cross members arranged in a direction perpendicular to the compactor and along both sides of the compaction roller, wherein the compaction roller frame is connected to a compactor main frame via one of the two cross members, and wherein at least one sight opening is provided within the other of the two cross members.

20 Claims, 4 Drawing Sheets

(51) Int. Cl.

| | |
|---|---|
| ***E02D 3/026*** | (2006.01) |
| ***E01C 19/26*** | (2006.01) |
| ***E02F 3/815*** | (2006.01) |
| ***E02F 3/96*** | (2006.01) |
| *E02F 9/22* | (2006.01) |

(58) Field of Classification Search
CPC ..... E02D 2200/16; E02D 2200/165; E02F 9/2271; E02F 9/22
See application file for complete search history.

(56) References Cited

U.S. PATENT DOCUMENTS

| | | | | |
|---|---|---|---|---|
| 3,183,804 | A * | 5/1965 | Letourneau | E02D 3/026 404/121 |
| 3,900,272 | A * | 8/1975 | Domenighetti | E01C 19/233 404/130 |
| 4,098,344 | A * | 7/1978 | Johnson | E02D 3/026 172/170 |
| 5,104,257 | A * | 4/1992 | Lebrero Martinez | B62D 33/0604 180/20 |
| 5,676,493 | A * | 10/1997 | Brockway | E02D 3/026 404/121 |
| 7,805,865 | B2 * | 10/2010 | Paske | E01C 19/286 37/403 |
| 8,376,655 | B2 | 2/2013 | Marsolek et al. | |
| 8,550,745 | B2 * | 10/2013 | Thompson | E02D 3/039 172/518 |
| 9,630,657 | B2 * | 4/2017 | Ries | B62D 25/168 |
| 2010/0086354 | A1 | 4/2010 | Marsolek et al. | |
| 2010/0098521 | A1 * | 4/2010 | Kartal | E01C 19/281 414/680 |
| 2014/0301785 | A1 * | 10/2014 | Meier | E01C 19/23 404/122 |

FOREIGN PATENT DOCUMENTS

| | | |
|---|---|---|
| DE | 102013203860 | 9/2014 |
| EP | 1029982 | 8/2000 |
| WO | 99/11875 | 3/1999 |

OTHER PUBLICATIONS

European Search Report of EP 17166732.2 dated Jul. 21, 2017, 6 pages.

* cited by examiner

SOIL COMPACTOR

BACKGROUND

The present invention relates to a soil compactor that can be used, for example, to prepare the surface of a substrate to be paved with asphalt in road construction or to compact the asphalt placed upon said substrate.

Known from DE 10 2013 203 860 A1 is a soil compactor, which essentially comprises a front end provided with a compaction roller supported on a compaction roller frame and rotatable around a rotational axis. The compaction roller comprises two longitudinal members arranged in a direction longitudinal to the compactor on both sides of the compaction roller and supporting said compaction roller. Between these two longitudinal members are two cross members extending in a direction perpendicular to the compactor and along both sides of the compaction roller, hence extending in a direction essentially perpendicular to the compactor. The compaction roller frame is attached via one of these two cross members to a compactor main frame, meaning, for example, a rear end also supporting a drive unit. The other of the two cross members, meaning the cross member provided essentially on the forward area of the compactor, is offset upward in a direction vertical to the compactor with respect to the cross member that is connected to the compactor main frame, in principle thus situated at a somewhat greater distance from the substrate being compacted. This allows compaction to be carried out even in slope areas without the risk of this cross member coming into contact with the substrate to be compacted.

BRIEF DESCRIPTION

It is the object of the present invention to provide a soil compactor in which the person operating the soil compactor is offered an improved view of the ground to be compacted located in front of the soil compactor.

This object is achieved according to the invention by a soil compactor comprising a compaction roller rotatably supported by a compaction roller frame, whereby the compaction roller frame comprises two longitudinal members arranged in a direction longitudinal to the compactor on both sides of the compaction roller and supporting said compaction roller, and, connecting the two longitudinal members together, two cross members arranged in a direction perpendicular to the compactor and along both sides of the compaction roller, whereby the compaction roller frame is connected to a compactor main frame via one of the cross members, and whereby at least one sight opening is provided within the other of the two cross members.

Given that the soil compactor according to the invention is provided with at least one sight opening within the cross member also provided essentially on the general end area of the soil compactor, the person operating the soil compactor will be able to look through the sight opening and see the area immediately in front of the compaction roller supported by the compaction roller frame. This allows for greater precision when performing compaction work.

In order to obstruct the view of the operator as little as possible, it is proposed that the at least one sight opening be essentially open upward in a direction vertical to the compactor.

In order to nevertheless provide this portion of the cross member with sufficient stability, it is further proposed that the upper area of the at least one sight opening be furnished with at least one brace bridging said sight opening in a direction perpendicular to the compactor, whereby the at least one brace has a smaller cross-sectional area than the other cross member in the area of the at least one sight opening.

Given that a cab for the person operating the soil compactor is arranged generally in the middle of the compactor in a direction perpendicular to the compactor and the operator is also situated in the middle of the compactor—as viewed from a direction perpendicular to the compactor—while carrying out compaction operations, it is further proposed that one sight opening is arranged in the center of the compactor in a direction perpendicular to the compactor. The operator thus obtains a broader view of view through this centrally positioned sight opening in a direction perpendicular to the compactor. Another significant contribution to improving the view of the area in front of the compactor can be achieved in that the sight opening spans a distance in a direction perpendicular to the compactor at least 50%, preferably 70% of the extent of the other cross member in a direction perpendicular to the compactor, and/or the at least one sight opening spans a distance in a direction vertical to the compactor at least 50%, preferably at least 70% of the extent of the other cross member in a direction vertical to the compactor.

In order to improve stability, it can be further provided that the sight opening be divided into two sight opening areas by a preferably plate-like support element braced by the brace, which, in a direction perpendicular to the compactor, is arranged essentially in the middle of the compactor as well as with respect to the other cross member.

In an alternative embodiment particularly advantageous with regard to stability, it is further proposed that the other cross member comprises at least two cross member support elements arranged one above the other in a direction vertical to the compactor and forming a sight opening between them.

In order to be able to perform compaction using a soil compactor built according to the invention without the compaction roller frame coming into contact with the ground, it is proposed that the other cross member be offset upward with respect to the other cross member in a direction vertical to the compactor.

In order to increase the versatility of the soil compactor, it is proposed that a leveling blade be supported by the compaction roller frame so as to be movable in a direction vertical to the compactor.

In order that a leveling blade of this kind does not present a major obstruction to the field of view of the operator, it is further proposed that the upper area of the leveling blade in a direction vertical to the compactor has at least one leveling blade sight opening. It can, for example, be provided for this purpose that the upper area of the leveling blade be formed by a plurality of leveling blade bars essentially parallel to one another, preferably extending essentially parallel to the compaction roller axis of rotation, whereby at least one leveling blade sight opening is formed between at least two leveling blade bars.

In order that the leveling blade can be moved in a vertical direction, it is proposed that a leveling blade lifting mechanism, preferably a piston and cylinder unit, be supported in relation to the leveling blade and the other cross member. For this purpose, it is preferable that the leveling blade lifting mechanism be supported by the support element, which is braced in relation to the other cross member and the at least one brace bridging the sight opening.

BRIEF DESCRIPTION OF THE DRAWINGS

The present invention is described hereinafter in reference to the enclosed drawings. Shown are.

DETAILED DESCRIPTION

Figure 1:
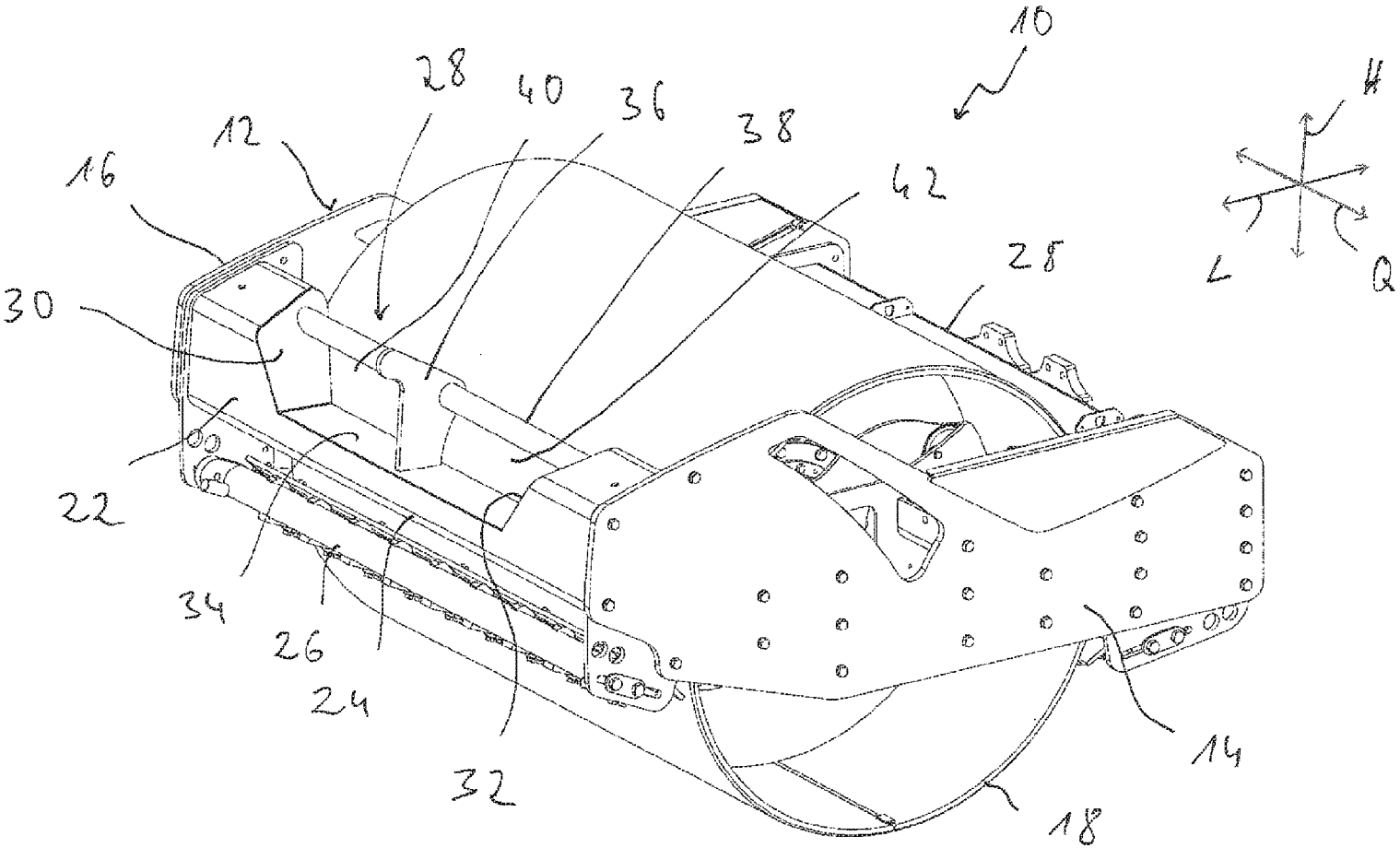
FIG. 1 a perspective view of a compaction roller frame with a compaction roller rotatably attached thereto.
Figure 4:
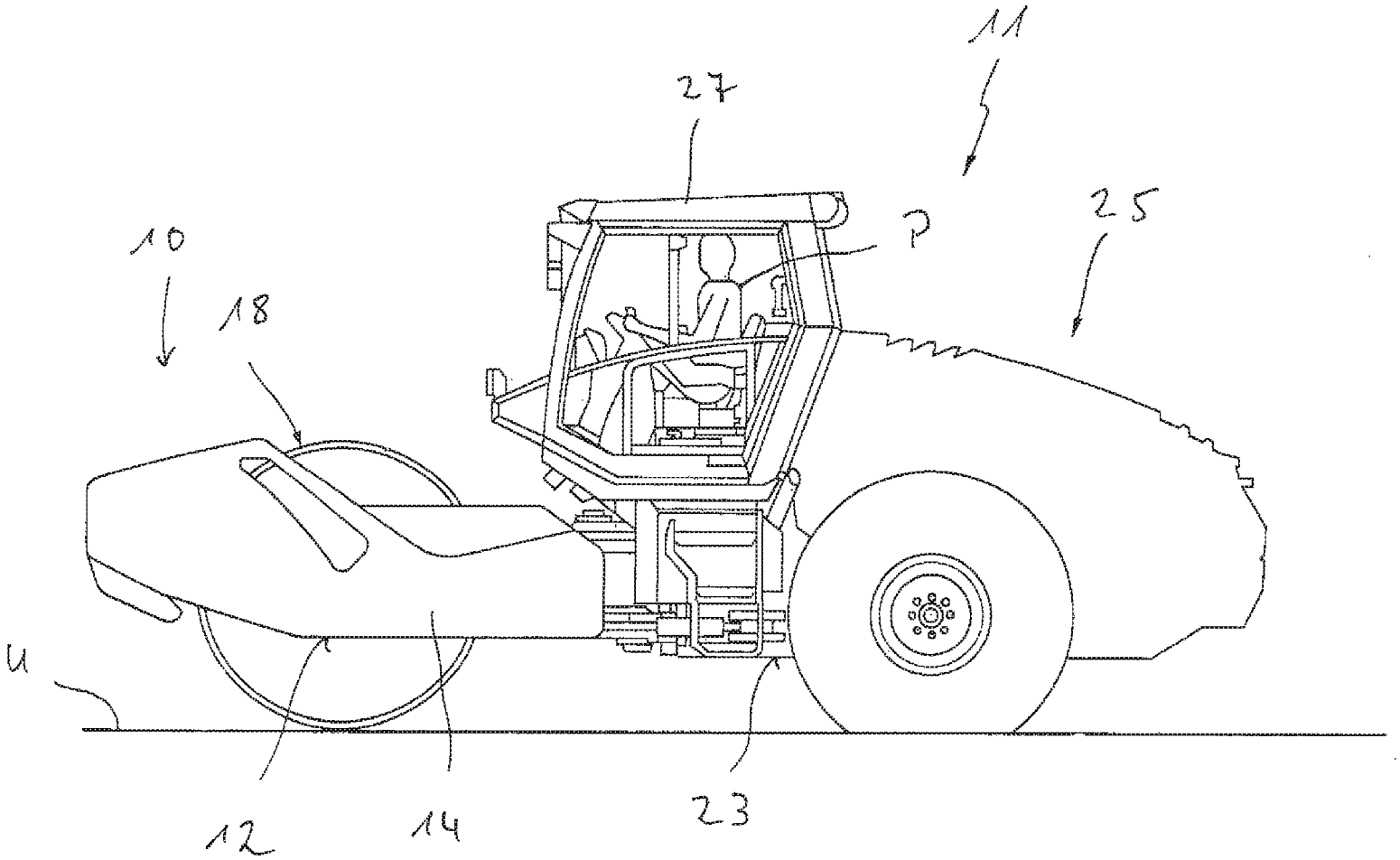
FIG. 4 a side view of a soil compactor.

FIG. 1 shows a portion generally termed as the front end 10 of the self-propelling soil compactor 11 shown in FIG. 4, which is designed as a single-drum compactor in the example shown. The front end 10 comprises a compaction roller frame 12 having two essentially plate-like longitudinal members 14, 16 extending in a direction L longitudinal to the compactor. Between these two longitudinal members 14, 16, a compaction roller generally termed as 18 is supported in such a way that the roller axis of rotation extends essentially in a direction Q perpendicular to the compactor, hence essentially at a right angle to a direction L longitudinal to the compactor so that the two longitudinal members 14, 16 are arranged on both sides of the compaction roller 18 and in a direction L longitudinal to the direction of the compactor. The compaction roller 18 can be rotatably supported by the longitudinal members 14, 16 in order to rotate about its roller axis of rotation.

Between the two longitudinal members 14, 16, two cross members 20, 22 extend essentially in a direction Q perpendicular to the compactor, meaning also essentially parallel to the axis of rotation of the compaction roller 18, said cross members consequently being arranged in a direction Q perpendicular to the compactor and along both sides of the compaction roller 18. The two cross members 20, 22 can be of a box-like design and—just as the longitudinal members 14, 16—are fashioned as steel parts.

The compaction roller frame 12 or rather the front end 10 is connected via the cross member 20 to a compactor main frame 23, which may be envisaged as a rear end 25. In order to steer a soil compactor 11 constructed in this way, the front end 10 may be articulatedly connected to the compaction main frame 23, for example able to be pivoted about a pivot axis that is approximately vertical to the direction H of the compactor.

As is apparent from FIG. 1, the two cross members 20, 22 are offset from one another in a direction H vertical to the compactor so that the cross member 20 connected or to be connected to the compactor main frame 23 is offset downward with respect to the other cross member 22 in a direction H vertical to the compactor. Consequently, the cross member 22 that is situated farther away from the compactor main frame 23 or the rear end 25 of the soil compactor 11 and essentially provided by, for example, the forward end area of the soil compactor 11 is situated so that its lower edge area 24 or rather the scraper 26 arranged beneath said cross member 22 is at a greater distance from the substrate being compacted in a direction H vertical to the compactor. The advantage of this is allowing compaction to be carried out with this front end 10 even in slope areas without the cross member 22 or the scraper 26 arranged thereunder coming into contact with the substrate U to be compacted.

In order to provide the operator P generally positioned in the cab 27 on the rear end 25 with a view of the immediately adjacent ground to be compacted, for example that in front of the compaction roller 18, the cross member 22, which, defines the forward end area of the soil compactor 11 when the front end 10 as depicted in FIG. 1 is moved to the left, has a sight opening 28. Said sight opening 28 extends completely through the cross member 22 in a direction L longitudinal to the compactor and is essentially open upward in a direction H vertical to the compactor and is bordered, for example, by two side walls 30, 32 or a base wall 34 formed by the cross member 22. In the area of the sight gap 28, the cross member 22 has a smaller cross-sectional dimension than the attached areas provided on either side of it and attached to the longitudinal members 14, 16. The sight gap 28 is provided essentially in the middle of the cross member 22 in a direction Q perpendicular to the compactor, whereby this middle area may be characterized, for example, by a plate-like support element 36 extending upward from the cross member 22 or the base wall 34. Bridging the upper area of the sight opening 28 and thus extending essentially in a direction Q perpendicular to the compactor, a brace 38 penetrates the plate-like support element 36 and is attached to the side walls 30, 32 of the cross member 22. A stable connection with both the cross member 22 and the plate-like support element 36 may be ensured, for example, by a welding joint.

In order to ensure the operator P a good view of the substrate U in front of the compaction roller 18, the sight opening 28 provided in the approximate middle of the cross member 22 spans a distance in a direction Q perpendicular to the compactor at least 50%, preferably 70% of the distance spanned by said cross member 22 in this direction. Doing so ensures that the operator P has an equally good view of the areas around the edge of the compaction roller 18 and the central area of the substrate U being compacted. It may be further provided for this purpose that the sight opening 28 spans a distance, thus basically a depth, in a direction H vertical to the compactor of at least 50%, preferably at least 70% of the distance spanned, thus basically the thickness, of the cross member 22 in said direction H vertical to the compactor.

The brace 38 braces the cross member 22, but does so essentially without obstructing the view through the sight opening 28. The plate-like support element 36, which, due to its central position and due to the central position of the sight opening 28, is also connected to the brace 38 midway along the length of the brace for the purpose of bracing. The sight opening 28, which is basically open in an upward direction, is consequently divided into two sight opening sections 40, 42 by the plate-like support element 36.

Figure 2:
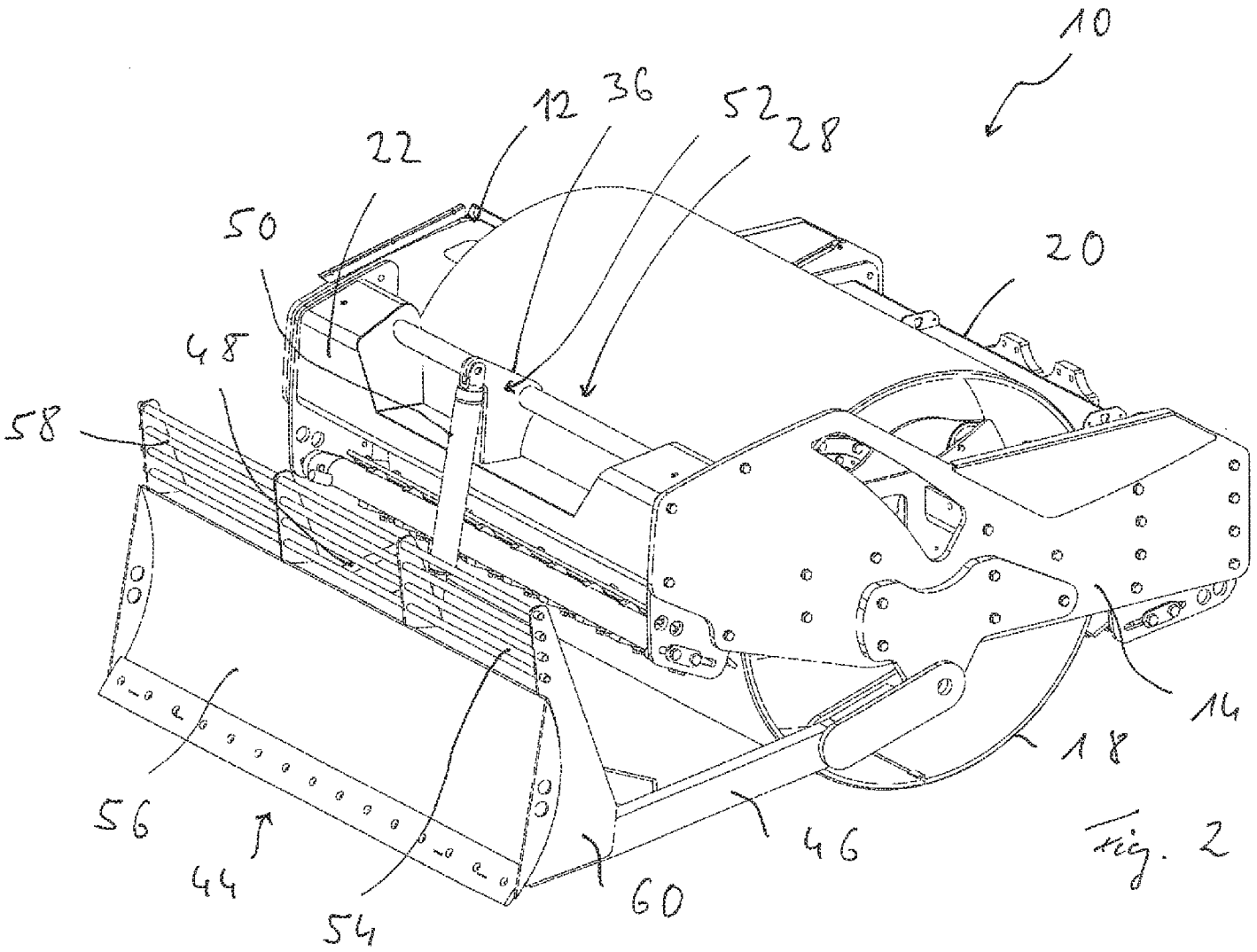
FIG. 2 the compaction roller frame shown in FIG. 1 with a leveling blade attached.
Figure 3:
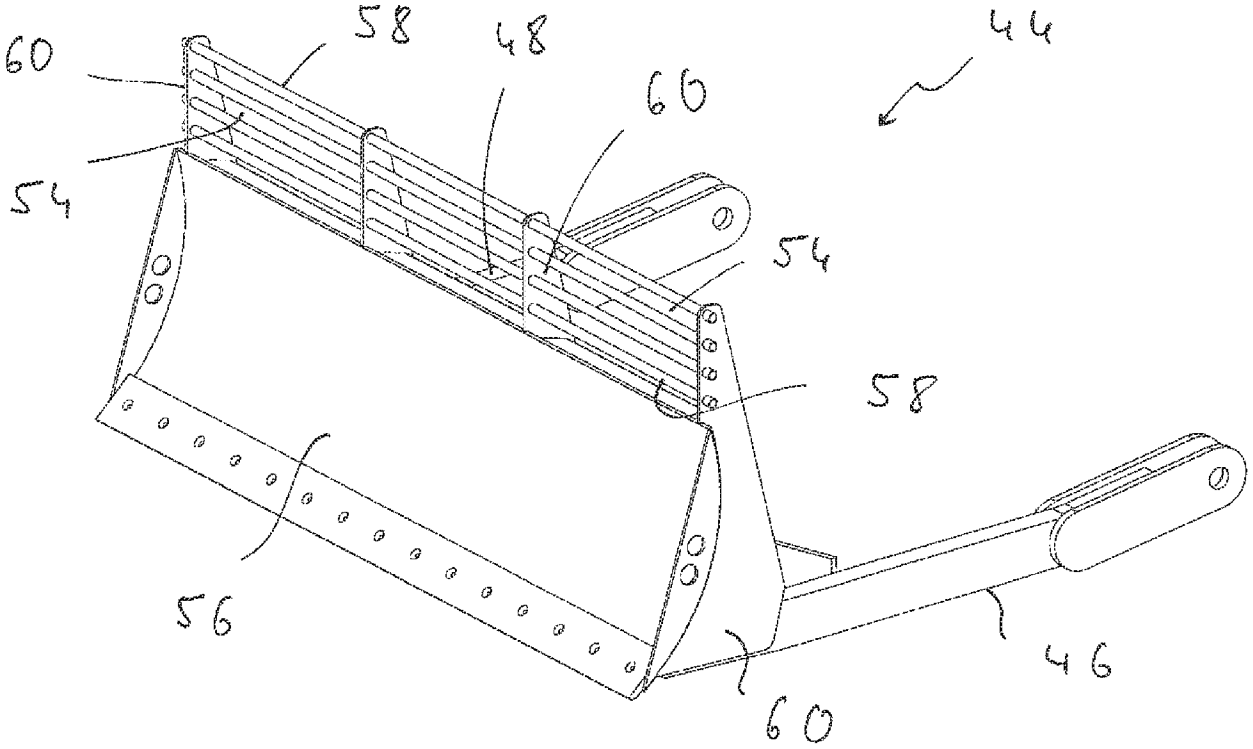
FIG. 3 the leveling blade shown in FIG. 2.

FIG. 2 shows the front end 10 from FIG. 1 with its compaction roller frame 12 connected to a pivotably supported leveling blade 44. The leveling blade 44 comprises pivoting arms 46, 48 at a distance from both ends of the leveling blade in a direction H perpendicular to the compactor, said pivoting arms supported by the compaction roller frame 12 in the area of the two longitudinal members 14, 16 and pivotable about a pivot axis that is essentially parallel to the roller axis of rotation or to a direction Q perpendicular to the compactor. A piston and cylinder unit 50 is provided with a leveling blade lifting mechanism 52, using which the leveling blade 44 can be raised or lowered. One end of the piston and cylinder unit 50 can thus be attached to an area midway along the length of the leveling blade 44, and the other end pivotably connected to the cross member 22, in particular to the support element 36 supported thereon.

In order that the leveling blade 44 does not significantly obstruct the view of the substrate U in front of the compaction roller 18, the upper area of the leveling blade 44 in a direction vertical to the compactor is formed by a plurality of leveling blade sight openings 54. These can be provided essentially through leveling blade bars 58 extending above the blade portion 56 of the leveling blade 44 in a direction Q perpendicular to the compactor. The leveling blade bars 58 thus extend the effective working area of the leveling blade 44 upward and beyond the blade portion 56, but allow the substrate U immediately in front of the compaction roller 18 or in front of the leveling blade 44 to be viewed through this area. For this purpose, the leveling blade bars 58 can be fixedly supported by a plurality of leveling blade plates 60 situated side by side in a direction Q perpendicular to the compactor, which also support the blade portion 56.

Due to the sight opening 28 being provided, preferably in an area in the middle of the cross member 22 and preferably spanning such a distance that it occupies at least 50% and preferably at least 70% of the distance spanned by the cross member 22 in a direction Q perpendicular to the compactor, the operator P obtains an essentially open view of the substrate U in front of the compaction roller 18 to be compacted by looking through the upper area of the compaction roller 18. The components used for stabilizing or bracing the cross member 22, in particular the brace 38, do not significantly obstruct the view of this area of the substrate U. The embodiment of the leveling blade 44 according to the invention likewise enables an essentially unobstructed view of the area immediately in front of said leveling blade 44.

It is worthy of note that this construction according to the invention, that of the cross member 22 in particular, is significantly advantageous if said cross member 22 is offset upward in a direction H vertical to the compactor with respect to the cross member 20 connecting to the compactor main frame 23 and, absent the provision of the sight opening, lying within the field of view of the operator P.

The principles of the present invention, meaning the provision of a sight opening, may also be achieved in other ways. The cross member 22 may thus also be provided through two or more cross member support elements arranged above one another in a direction H vertical to the compactor extending between the two longitudinal members 14, 16, sight openings being provided between each of them. Also, in a design of the cross member 22 in the manner shown in FIG. 1, several of the sight openings can be provided successively in a direction Q perpendicular to the compactor.

The invention claimed is:

1. Soil compactor comprising a compaction roller rotatably supported by a compaction roller frame, wherein the compaction roller frame comprises two longitudinal members arranged in a direction longitudinal to the compactor on both sides of the compaction roller and supporting said compaction roller, and, connecting the two longitudinal members together, two cross members arranged in a direction perpendicular to the compactor and along both sides of the compaction roller, wherein the compaction roller frame is connected to a compactor main frame via one of the two cross members, and wherein at least one sight opening is provided within the other of the two cross members, wherein the at least one sight opening is essentially open upward in a direction vertical to the compactor, and wherein the upper area of the at least one sight opening is furnished with at least one brace bridging said sight opening in a direction perpendicular to the compactor, and further wherein the at least one brace has a smaller cross-sectional area than the other cross member in the area of the at least one sight opening.

2. Soil compactor according to claim 1, wherein a sight opening is centrally arranged in the middle of the compactor in a direction perpendicular to the compactor, and/or that the least one sight opening spans a distance in a direction perpendicular to the compactor of at least 50% of the distance spanned by the other cross member in a direction perpendicular to the compactor, and/or that the at least one sight opening spans a distance in a direction vertical to the compactor of at least 50% of the distance spanned by the other cross member in a direction vertical to the compactor.

3. Soil compactor according to claim 1, wherein the sight opening is divided into two sight opening areas by a plate-like support element braced by the brace, which, in a direction perpendicular to the compactor, is arranged essentially in the middle of the compactor as well as with respect to the other cross member.

4. Soil compactor according to claim 1, wherein the other cross member comprises at least two cross member support elements arranged one above the other in a direction vertical to the compactor and forming a sight opening between them.

5. Soil compactor according to claim 1, wherein the other cross member is offset upward with respect to the other cross member in a direction vertical to the compactor.

6. Soil compactor according to claim 1, wherein a leveling blade is supported by the compaction roller frame so as to be movable in a direction vertical to the compactor.

7. Soil compactor according to claim 6, wherein the upper area of the leveling blade in a direction vertical to the compactor has at least one leveling blade sight opening.

8. Soil compactor according to claim 7, wherein the upper area of the leveling blade is formed by a plurality of leveling blade bars essentially parallel to one another, wherein at least one leveling blade sight opening is formed between at least two leveling blade bars.

9. Soil compactor according to claim 6, wherein a leveling blade lifting mechanism is supported in relation to the leveling blade and the other cross member.

10. Soil compactor according to claim 3, wherein a leveling blade is supported by the compaction roller frame so as to be movable in a direction vertical to the compactor, and wherein a leveling blade lifting mechanism is supported in relation to the leveling blade and the other cross member, and further wherein the leveling blade lifting mechanism is supported by the support element.

11. Soil compactor according to claim 3, wherein a sight opening is centrally arranged in the middle of the compactor in a direction perpendicular to the compactor, and/or that the least one sight opening spans a distance in a direction perpendicular to the compactor of at least 50% and/or that the at least one sight opening spans a distance in a direction vertical to the compactor of at least 50%.

12. Soil compactor according to claim 10, wherein a leveling blade lifting mechanism is supported in relation to the leveling blade and the other cross member.

13. Soil compactor comprising a compaction roller rotatably supported by a compaction roller frame, wherein the compaction roller frame comprises two longitudinal members arranged in a direction longitudinal to the compactor on both sides of the compaction roller and supporting said compaction roller, and, connecting the two longitudinal members together, two cross members arranged in a direction perpendicular to the compactor and along both sides of the compaction roller, wherein the compaction roller frame is connected to a compactor main frame via one of the two cross members, and wherein at least one sight opening is provided within the other of the two cross members, wherein the other cross member comprises at least two cross member support elements arranged one above the other in a direction vertical to the compactor and forming a sight opening between them.

14. Soil compactor comprising a compaction roller rotatably supported by a compaction roller frame, wherein the compaction roller frame comprises two longitudinal members arranged in a direction longitudinal to the compactor on both sides of the compaction roller and supporting said compaction roller, and, connecting the two longitudinal members together, two cross members arranged in a direction perpendicular to the compactor and along both sides of the compaction roller, wherein the compaction roller frame is connected to a compactor main frame via one of the two cross members, and wherein at least one sight opening is provided within the other of the two cross members, wherein a leveling blade is supported by the compaction roller frame so as to be movable in a direction vertical to the compactor, and wherein the upper area of the leveling blade in a direction vertical to the compactor has at least one leveling blade sight opening.

15. Soil compactor according to claim 14, wherein the upper area of the leveling blade is formed by a plurality of leveling blade bars essentially parallel to one another, wherein at least one leveling blade sight opening is formed between at least two leveling blade bars.

16. Soil compactor according to claim 15, wherein the leveling blade bars extend essentially parallel to the compaction roller axis of rotation.

17. Soil compactor according to claim 14, wherein a leveling blade lifting mechanism is supported in relation to the leveling blade and the other cross member.

18. Soil compactor according to claim 17, wherein:

the at least one sight opening is essentially open upward in a direction vertical to the compactor, the upper area of the at least one sight opening is furnished with at least one brace bridging said sight opening in a direction perpendicular to the compactor, wherein the at least one brace has a smaller cross-sectional area than the other cross member in the area of the at least one sight opening, the sight opening is centrally arranged relative to a middle of the compactor in a direction perpendicular to the compactor, the sight opening is divided into two sight opening areas by a support element braced by the brace, which, in the direction perpendicular to the compactor, is arranged essentially in the middle of the compactor as well as with respect to the other cross member, and wherein the leveling blade lifting mechanism is supported by the support element.

19. Soil compactor according to claim 17, wherein the leveling blade lifting comprises a piston and cylinder unit.

20. Soil compactor according to claim 17, wherein the support element is provided plate-like.

* * * * *